US006394454B1

(12) United States Patent
Etherington, Jr. et al.

(10) Patent No.: US 6,394,454 B1
(45) Date of Patent: May 28, 2002

(54) BOARD GAME

(76) Inventors: Gary Etherington, Jr., N 11275 Elmo St. P.O. Box 143; Robert Morrison, P.O. Box 364, both of Elcho, WI (US) 54428

( * ) Notice: Subject to any disclaimer, the term of this patent is extended or adjusted under 35 U.S.C. 154(b) by 0 days.

(21) Appl. No.: 09/540,516

(22) Filed: Mar. 31, 2000

(51) Int. Cl.[7] ..... A63F 3/00
(52) U.S. Cl. ..... 273/243; 273/236
(58) Field of Search ..... 273/236, 243, 273/248, 249

(56) References Cited

U.S. PATENT DOCUMENTS 4,211,419 A * 7/1980 Larson
4,248,437 A * 2/1981 Lemberger
5,607,159 A * 3/1997 Bryson
5,791,650 A * 8/1998 Pardee

FOREIGN PATENT DOCUMENTS

GB 196439 A * 2/1922
GB 2199253 A * 7/1988
GB 2214825 A * 9/1989
GB 2225728 A * 6/1990

* cited by examiner

*Primary Examiner*—Benjamin H. Layno
*Assistant Examiner*—Vishu K Mendiratta

(57) ABSTRACT

A board game for challenging players to move all of their game pieces from the start space to the finishing space. The board game includes a game board having a first path and a second path. The first path encompasses the second path. The first and second paths are connected by a plurality of connector paths. The first path, the second path and the plurality of connector paths are divided into path spaces. A plurality of starting spaces on the game board are located generally adjacent the first path. A plurality of ending paths are connected to the first path. A plurality of sets of game pieces. A plurality of cards for indicating movement of game pieces about the game board. Wherein cards are drawn to determine movement of the game pieces about the first path. The game is won by moving the set of game pieces to the end of the ending path.

13 Claims, 2 Drawing Sheets

BOARD GAME

BACKGROUND OF THE INVENTION

1. Field of the Invention

The present invention relates to games and more particularly pertains to a new board game for challenging players to move all of their game pieces from the start space to the finishing space.

2. Description of the Prior Art

The use of games is known in the prior art. More specifically, games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,030,762; U.S. Pat. No. 1,518,306; U.S. Des. Pat. No. 320,237; U.S. Pat. No. 5,758,876; U.S. Pat. No. 5,433,450; and U.S. Pat. No. 2,787,469.

While these devices fulfill their respective, particular objectives and requirements, the aforementioned patents do not disclose a new board game. The inventive device includes a game board having a first path and a second path. The first path encompasses the second path. The first and second paths are connected by a plurality of connector paths. The first path, the second path and the plurality of connector paths are divided into path spaces. A plurality of starting spaces on the game board are located generally adjacent the first path. A plurality of ending paths are connected to the first path. A plurality of sets of game pieces. A plurality of cards for indicating movement of game pieces about the game board. Wherein cards are drawn to determine movement of the game pieces about the first path. The game is won by moving the set of game pieces to the end of the ending path.

In these respects, the board game according to the present invention substantially departs from the conventional concepts and designs of the prior art, and in so doing provides an apparatus primarily developed for the purpose of challenging players to move all of their game pieces from the start space to the finishing space.

SUMMARY OF THE INVENTION

In view of the foregoing disadvantages inherent in the known types of games now present in the prior art, the present invention provides a new board game construction wherein the same can be utilized for challenging players to move all of their game pieces from the start space to the finishing space.

The general purpose of the present invention, which will be described subsequently in greater detail, is to provide a new board game apparatus and method which has many of the advantages of the games mentioned heretofore and many novel features that result in a new board game which is not anticipated, rendered obvious, suggested, or even implied by any of the prior art games, either alone or in any combination thereof.

To attain this, the present invention generally comprises a game board having a first path and a second path. The first path encompasses the second path. The first and second paths are connected by a plurality of connector paths. The first path, the second path and the plurality of connector paths are divided into path spaces. A plurality of starting spaces on the game board are located generally adjacent the first path. A plurality of ending paths are connected to the first path. A plurality of sets of game pieces. A plurality of cards for indicating movement of game pieces about the game board. Wherein cards are drawn to determine movement of the game pieces about the first path. The game is won by moving the set of game pieces to the end of the ending path.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new board game apparatus and method which has many of the advantages of the games mentioned heretofore and many novel features that result in a new board game which is not anticipated, rendered obvious, suggested, or even implied by any of the prior art games, either alone or in any combination thereof.

It is another object of the present invention to provide a new board game which may be easily and efficiently manufactured and marketed.

It is a further object of the present invention to provide a new board game which is of a durable and reliable construction.

An even further object of the present invention is to provide a new board game which is susceptible of a low cost of manufacture with regard to both materials and labor, and which accordingly is then susceptible of low prices of sale to the consuming public, thereby making such board game economically available to the buying public.

Still yet another object of the present invention is to provide a new board game which provides in the apparatuses and methods of the prior art some of the advantages thereof, while simultaneously overcoming some of the disadvantages normally associated therewith.

Still another object of the present invention is to provide a new board game for challenging players to move all of their game pieces from the start space to the finishing space.

Yet another object of the present invention is to provide a new board game which includes a game board having a first path and a second path. The first path encompasses the second path. The first and second paths are connected by a plurality of connector paths. The first path, the second path and the plurality of connector paths are divided into path spaces. A plurality of starting spaces on the game board are located generally adjacent the first path. A plurality of ending paths are connected to the first path. A plurality of sets of game pieces. A plurality of cards for indicating movement of game pieces about the game board. Wherein cards are drawn to determine movement of the game pieces about the first path. The game is won by moving the set of game pieces to the end of the ending path.

Still yet another object of the present invention is to provide a new board game that requires strategy for playing option cards and manipulating two separate paths.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
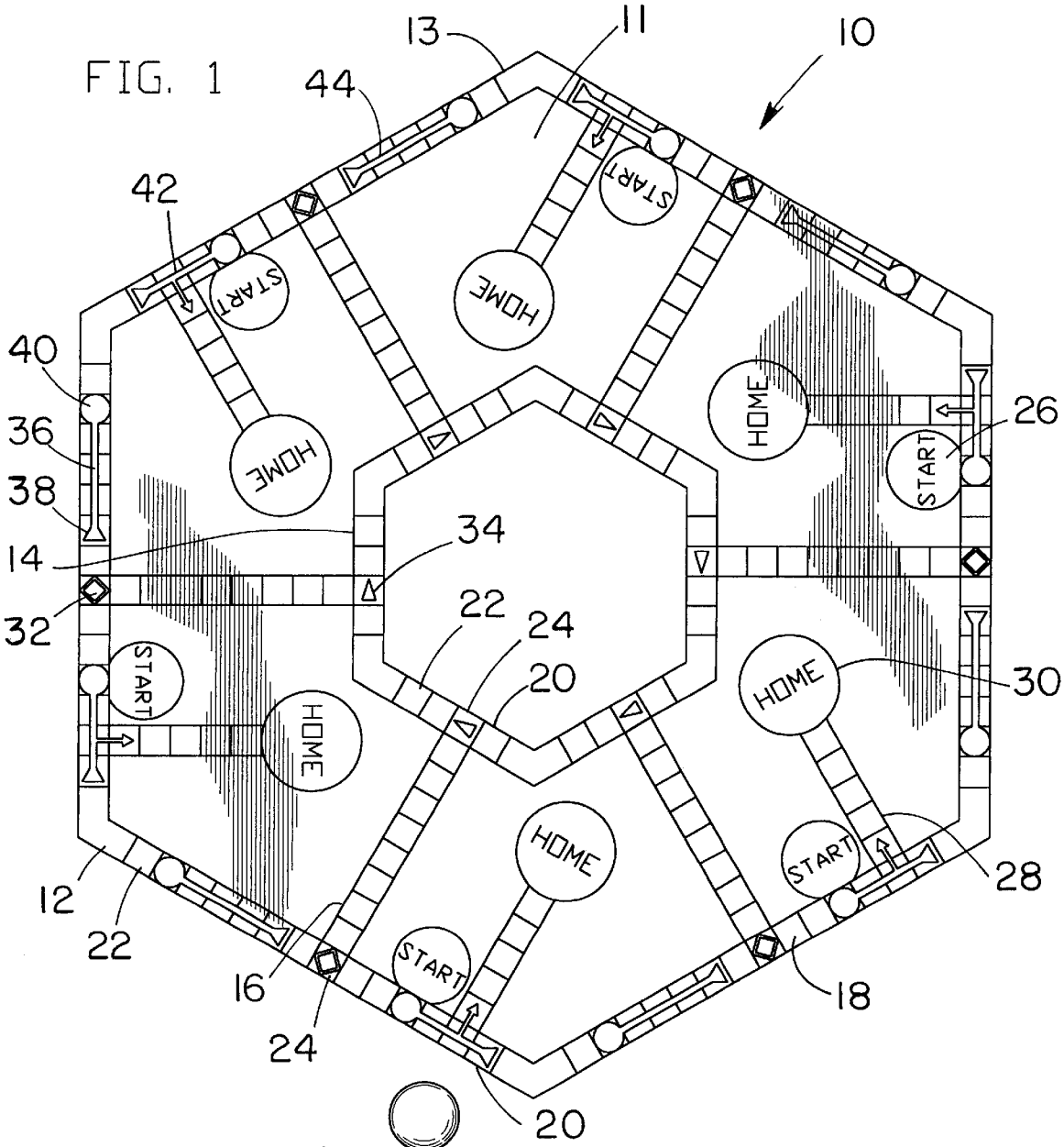
FIG. 1 is a schematic plan view of the game board of a new board game according to the present invention.
Figure 2:
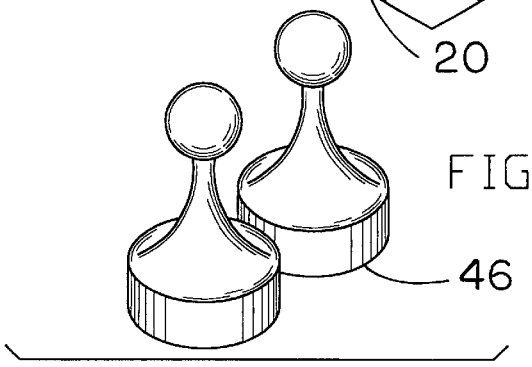
FIG. 2 is a schematic perspective view of the game pieces of the present invention.
Figure 3:
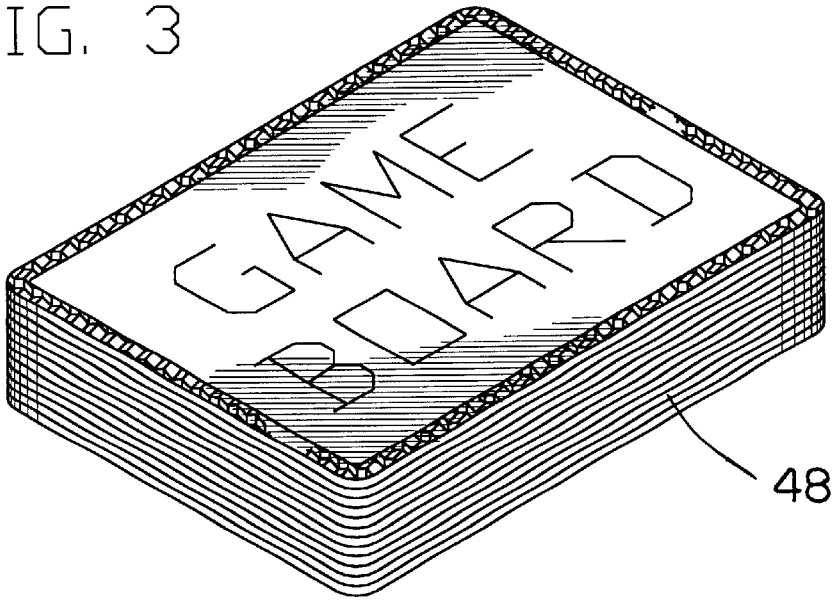
FIG. 3 is a schematic perspective view of the cards of the present invention.
Figure 4:
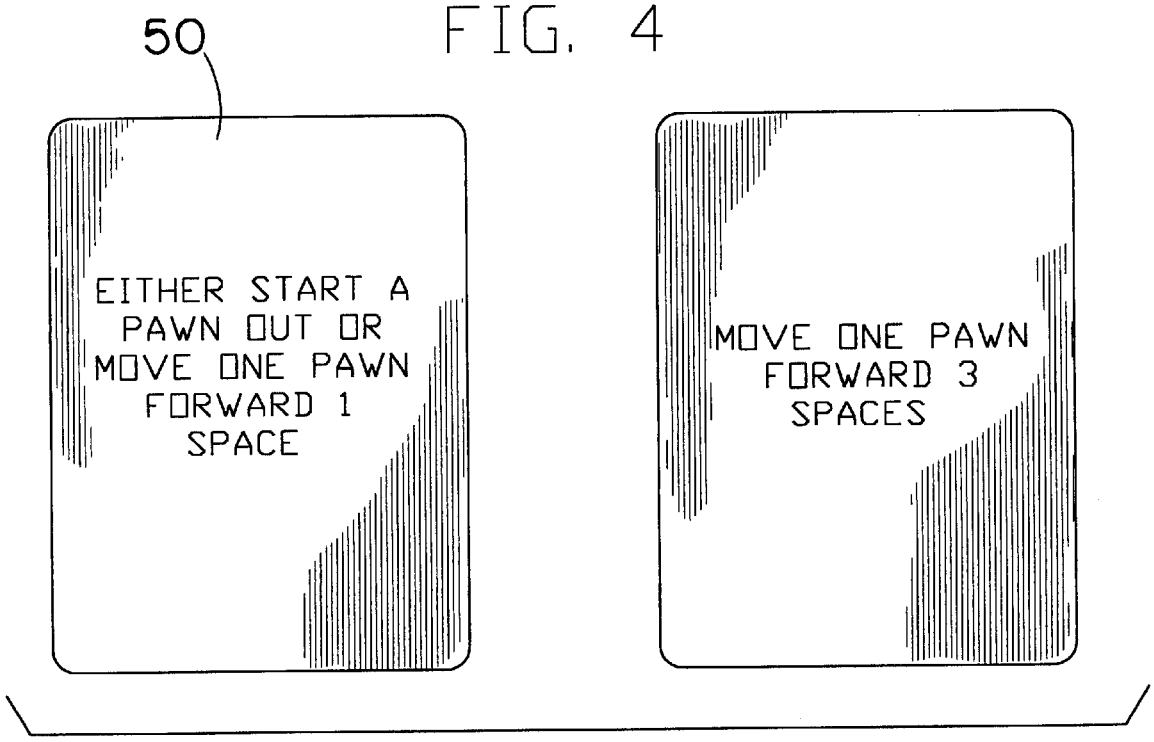
FIG. 4 is a schematic plan view of the cards of the present invention.

With reference now to the drawings, and in particular to FIGS. 1 through 4 thereof, a new board game embodying the principles and concepts of the present invention and generally designated by the reference numeral 10 will be described.

As best illustrated in FIGS. 1 through 4, the board game 10 generally comprises a game board 11 having a first path 12 and a second path 14. The first path 12 encompasses the second path 14 such that the second path 14 is an interior path and the first path 12 is a perimeter path. The first 12 and second 14 paths are connected by a plurality of connector paths 16. The first path 12, the second path 14 and the plurality of connector paths 16 are divided into path spaces 18. The first path 12 is positioned generally adjacent to a peripheral edge 13 of the game board 11. The game board 11 generally has an equilateral hexagonal shape. The first path 12 and the second path 14 each have six sides. The sides have a first end space 20, a second end space 22, and a central path space 24. The connector paths 16 connect the central path space 24 on the first path 12 with the central path space on the second path 14 such that each of the connector paths 16 is directed toward a central portion of the game board 11. Each of the first end spaces 20 on the paths are generally located to a right side of the connector paths 16.

A plurality of starting spaces 26 are on the game board. Each of the starting spaces 26 is located generally adjacent to one of the sides of the first path 12. The starting spaces 26 are between the first and second paths 14. Each of the starting spaces 26 is between one of the connector paths 16 and one of the first end path spaces 20.

A plurality of ending paths 28 are divided into path spaces. Each of the ending paths 28 has a finishing space 30. The ending paths 28 are connected to one of the sides of the first path 12. Each of the ending paths 28 is between the first and second paths 14. The ending paths 28 are generally located between one of the starting spaces 26 and one of the first end spaces 20.

Redirecting indicia on the first path directs players off of the first path 12 and onto the second path 14. Each of the redirecting indicia is located on one of the path spaces abutted against the connector paths 16. Each of the redirecting indicia has a generally diamond shape 32.

Direction indicia on the second path 14 direct players in a clockwise direction around the second path. The direction indicia is a plurality of arrows 34.

Sliding areas 36 have a beginning slide space 38 and an ending slide space 40. Each side of the first path 12 contains a first 42 and a second sliding area 44. The first sliding 42 areas have a beginning slide space 38 located in one of the first end spaces 20 of the sides of the first path 12. Each of the first sliding areas 42 has an ending slide space 40 located in one of the path spaces adjacent to one of the start spaces 26. Each of the second sliding areas 44 are located between one of the connector paths 16 and one of the second ends 22 of the sides of the first path 12.

Each combination of one of the starting spaces 26, an adjacent ending path 28 and an adjacent sliding area 36 has a different color than any other of the combinations. Ideally, the colors are blue, green, red, orange, blue and purple.

There are six sets of four game pieces 46. Each of the sets has a color associated with one of the combinations.

Cards 48 indicate movement of game pieces about the game board. Each of the cards has indicia 50 thereon indicating movement. The indicia includes the numbers one through twelve and wild cards. A one indicates moving a game piece forward one space. A two indicates moving a game piece forward two spaces and drawing another card. A three indicates moving a game piece forward three spaces. A four indicates moving a game piece backward four spaces. A five indicates moving a game piece forward five spaces. A six indicates moving a game piece forward six spaces. A seven indicates moving a game piece forward seven spaces or dividing movement of seven spaces between two game pieces. An eight indicates moving a game piece forward eight spaces. A nine indicates moving a game piece forward or backward nine spaces, or dividing the nine spaces by moving one game piece forward and a second game piece backward such that the backward and forward movement equals nine spaces. A ten indicates moving a game piece forward ten spaces or backward one space. An eleven indicates moving a game piece forward eleven spaces or switching a game piece with an opponents game piece. A twelve indicates moving a game piece forward twelve spaces. A wild indicia indicates switching the game piece in the starting space with an opponent's game piece such that the opponent's game piece is returned to its starting space. If there are no game pieces to switch with, the player looses their turn.

Rules of the Game

The game requires two to six players.

Each player chooses a set of game pieces.

Each player places the set of game pieces in a matching colored starting space.

Each player draws a card. The player with the highest card begins play.

The first player draws a card, wherein the player requires a card having a one or two indicia to move one of the game pieces from the starting space onto the first path.

The players, in turn, draw cards to determine movement about the first path.

A game piece is moved up the connector path if the game piece ends its turn on one of the redirecting spaces. The player travels about the second path until the player chooses to leave via a connector path. A player traveling from the first path toward the second path may travel back to the first path if the player draws a backward movement card.

The game piece slides on the sliding areas from the beginning sliding space to the ending sliding space if the game piece ends it turn by landing on the beginning sliding space. A game piece with the same color as the color of the sliding area does not slide when the game piece lands on the beginning sliding space.

A game piece is sent back to its start space by landing in the game pieces path space by another game piece.

A game piece is sent back to its start space by landing on one of the beginning sliding spaces while the game piece is in the sliding area.

The game is won by moving the set of game pieces to the finishing space having a color identical to the set of game pieces. A game piece may only enter the finishing path having a finishing space having an identical color indicia. The player may move their game pieces backwards out of the finishing path but may not enter the finishing path backwards. The ending path defines a safety zone, wherein the game pieces in the safety zone can not be switched with other game pieces. Game pieces may enter the finishing space only if the number indicia on the card equals a number of path spaces needed to move the game piece into the finishing space.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A method of playing a game, comprising the steps of:

providing a game board, said game board having a first path and a second path, said second path being encompassed by said first path, said first and second path being connected by a plurality of connector paths, each of said first path, said second path and said plurality of connector paths being divided into path spaces;

providing a plurality of starting spaces on said game board each of said starting spaces being located generally adjacent said first path;

providing a plurality of ending paths, each of said ending paths being connected to said first path;

providing a plurality of sets of game pieces;

providing a plurality of cards for indicating movement of game pieces about said game board, each of said cards having indicia thereon indicating movement, said indicia being chosen from the group consisting of a one indicating moving a game piece forward one space, a two indicating moving a game piece forward two spaces and drawing another card, a three indicating moving a game piece forward three spaces, a four indicating moving a game piece backward four spaces, a five indicating moving a game piece forward five spaces, a six indicating moving a game piece forward six spaces, a seven indicating moving a game piece forward seven spaces or divide movement of seven spaces between two game pieces, an eight indicating moving a game piece forward eight spaces, a nine indicating moving a game piece forward or backward nine spaces or divide the nine spaces by moving one game piece forward and a second game piece backward, a ten indicating moving a game piece forward ten spaces or backward one space, an eleven indicating moving a game piece forward eleven spaces or switching a game piece with an opponents game piece, a twelve indicating moving a game piece forward twelve spaces, and a wild indicia indicating switching said game piece in said starting space with an opponent's game piece such that said opponent's game piece is returned to its starting space;

drawing a card to determine movement of said game pieces about the first path; and winning said game by moving said set of game pieces to said ending path.

2. The method of playing a game as in claim 1, wherein the step of providing a game board further includes:

said first path being positioned generally adjacent to a peripheral edge of said game board, said game board generally having an equilateral hexagonal shape, said first path and said second path each having six sides, each of said sides having a first end space and a second end space, each of said sides of said first and second paths having a central path space, wherein each of said connector paths connect said central path space on said first path with said central path space on said second path such that each of said connector paths is directed toward a central portion of said game board, wherein each of said first end spaces on said paths is generally located to a right side of said connector paths.

3. The method of playing a game as in claim 2, wherein said steps comprise:

each of said starting spaces being between said first and second paths, each of said starting spaces being between one of said connector paths and on of said first end path spaces;

each of said ending paths being divided into path spaces, each of said ending paths having a finishing space, each of said ending paths being connected to one of said sides of said first path, each of said ending paths being between said first and second paths, each of said ending paths being generally located between one of said starting spaces and one of said first end spaces.

4. The method of playing a game as in claim 3, wherein said steps comprise:

each combination of one of said starting spaces, an adjacent ending path and an adjacent sliding area has a different color than any other of said combinations;

said plurality of sets of game pieces being six sets of four pieces, each of said sets having a color associated with one of said combinations.

5. The method of playing a game as in claim 4, further comprising the steps of:

providing a plurality of sliding areas, each of said sliding areas having beginning slide space and an a ending slide space, and sliding on said sliding areas from said beginning sliding space to said ending sliding space if said game piece ends it turn by landing on said beginning sliding space, wherein a game piece having a color substantially identical to a color of said sliding area does not slide when said game piece lands on said beginning sliding space.

6. The method of playing a game as in claim 4, wherein the step of winning said game comprises:

winning said game by moving said set of game pieces to said finishing space having a color identical to said set of game pieces, said ending path defining a safety zone, wherein said game pieces in said safety zone can not be switched with other game pieces, wherein game pieces may not move backwards from said first path into said ending path, wherein game pieces may enter said finishing space only if a number indicia on said card equals a number of path spaces needed to move said game piece into said finishing space.

7. The method of playing a game as in claim 1, further comprising the steps of:

providing a plurality of sliding areas, each of said sliding areas having beginning slide space and an a ending slide space, and sliding on said sliding areas from said beginning sliding space to said ending sliding space if said game piece ends it turn by landing on said beginning sliding space.

8. The method of playing a game as in claim 7, further comprising the step of:

sending a game piece positioned on a particular sliding area back to its start space when another one of said game pieces lands on the beginning sliding space of the particular sliding area.

9. The method of playing a game as in claim 1, further comprising the steps of:

providing redirecting indicia on said first path for directing players off of said first path and onto said second path, each of said redirecting indicia being located on one of said path spaces abutted against said connector paths, each of said redirecting indicia having a generally diamond shape; and moving up said connector path if said game piece ending its turn on one of said redirecting spaces, traveling about said second path until the player chooses to leave said second path and travel to said first path via a connector path, wherein a player traveling from said first path toward said second path on a connector path may travel back to said first path if a card having backward movement indicia thereon is drawn.

10. The method of playing a game as in claim 1, further comprising the step of:

sending a game piece back to its start space by landing in said game piece's path space by another game piece.

11. The method of playing a game as in claim 1, further including the following steps:

said first path being positioned generally adjacent to a peripheral edge of said game board, said game board generally having an equilateral hexagonal shape, said first path and said second path each having six sides, each of said sides having a first end space and a second end space, each of said sides of said first and second paths having a central path space, wherein each of said connector paths connector paths connect said central path space on said first path with said central path space on said second path such that each of said connector paths is directed toward a central portion of said game board, wherein each of said first end spaces on said paths is generally located to a right side of said connector paths;

each of said starting spaces being located generally adjacent to one of said sides of said first path, each of said starting spaces being between said first and second paths, each of said starting spaces being between one of said connector paths and on of said first end path spaces;

each of said ending paths being divided into path spaces, each of said ending paths having a finishing space, each of said ending paths being connected to one of said sides of said first path, each of said ending paths being between said first and second paths, each of said ending paths being generally located between one of said starting spaces and one of said first end spaces;

providing redirecting indicia on said first path for directing players off of said first path and onto said second path, each of said redirecting indicia being located on one of said path spaces abutted against said connector paths, each of said redirecting indicia having a generally diamond shape;

providing direction indicia on said second path for directing players in a clockwise direction around said second path, said direction indicia being a plurality of arrows;

providing a plurality of sliding areas, each of said sliding areas having beginning slide space and an a ending slide space, wherein each side of said first path contains a first and a second sliding area, each of said first sliding areas having a beginning slide space being located in one of said first end spaces of said sides of said first path, each of said first sliding areas having an ending slide space being located in one of said path spaces adjacent to one of said start spaces, each of said second sliding areas being located between one of said connector paths and one of said second ends of said sides of said first path;

wherein each combination of one of said starting spaces, an adjacent ending path and an adjacent sliding area has a different color than any other of said combinations;

said plurality of game pieces being six sets of four pieces, each of said sets having a color associated with one of said combinations;

providing a plurality of players;

choosing a set of game pieces;

placing said set of game pieces in a matching colored starting space;

drawing a card, wherein the player requires said one or said two indicia to move one of said game pieces from said starting space onto said first path;

drawing a card to determine movement about the first path;

moving up said connector path if said game piece ending its turn on one of said redirecting spaces, traveling about said second path until the player chooses to leave via a connector path, wherein a player traveling from said first path toward said second path may travel back to said first path if one of said cards having backward movement indicia thereon is drawn;

sliding on said sliding areas from said beginning sliding space to said ending sliding space if said game piece ends it turn by landing on said beginning sliding space, wherein a game piece having a color substantially identical to a color of said sliding area does not slide when said game piece lands on said beginning sliding space;

sending a game piece back to its start space by landing in said game pieces path space by another game piece;

sending a game piece back to its start space by landing on one of said beginning sliding spaces while said game piece being in said sliding area;

winning said game by moving said set of game pieces to said finishing space having a color identical to said set of game pieces, said ending path defining a safety zone, wherein said game pieces in said safety zone can not be switched with other game pieces, wherein game pieces may not move backwards from said first path into said ending path, wherein game pieces may enter said finishing space only if said number indicia on said card equals a number of path spaces needed to move said game piece into said finishing space.

12. A method of playing a game, comprising the steps of:

providing a game board, said game board having a first path and a second path, said second path being encompassed by said first path, said first and second path being connected by a plurality of connector paths, each of said first path, said second path and said plurality of connector paths being divided into path spaces, said first path being positioned generally adjacent to a peripheral edge of said game board, said game board generally having an equilateral hexagonal shape, said first path and said second path each having six sides, each of said sides having a first end space and a second end space, each of said sides of said first and second paths having a central path space, wherein each of said connector paths connect said central path space on said first path with said central path space on said second path such that each of said connector paths is directed toward a central portion of said game board, wherein each of said first end spaces on said paths is generally located to a right side of said connector paths;

providing a plurality of starting spaces on said game board each of said starting spaces being located generally adjacent said first path, each of said starting spaces being between said first and second paths, each of said starting spaces being between one of said connector paths and on of said first end path spaces;

providing a plurality of ending paths, each of said ending paths being connected to said first path, each of said ending paths being divided into path spaces, each of said ending paths having a finishing space, each of said ending paths being connected to one of said sides of said first path, each of said ending paths being between said first and second paths, each of said ending paths being generally located between one of said starting spaces and one of said first end spaces, each combination of one of said starting spaces, an adjacent ending path and an adjacent sliding area has a different color than any other of said combinations;

providing a plurality of sets of game pieces, said plurality of sets of game pieces being six sets of four pieces, each of said sets having a color associated with one of said combinations;

providing a plurality of cards for indicating movement of game pieces about said game board;

drawing a card to determine movement of said game pieces about the first path; and winning said game by moving said set of game pieces to said finishing space having a color identical to said set of game pieces, said ending path defining a safety zone, wherein said game pieces in said safety zone can not be switched with other game pieces, wherein game pieces may not move backwards from said first path into said ending path, wherein game pieces may enter said finishing space only if a number indicia on said card equals a number of path spaces needed to move said game piece into said finishing space.

13. The method of playing a game as in claim 12, wherein said step of providing a plurality of cards comprises:

each of said cards having indicia thereon indicating movement, said indicia being chosen from the group consisting of a one indicating moving a game piece forward one space, a two indicating moving a game piece forward two spaces and drawing another card, a three indicating moving a game piece forward three spaces, a four indicating moving a game piece backward four spaces, a five indicating moving a game piece forward five spaces, a six indicating moving a game piece forward six spaces, a seven indicating moving a game piece forward seven spaces or divide movement of seven spaces between two game pieces, an eight indicating moving a game piece forward eight spaces, a nine indicating moving a game piece forward or backward nine spaces or divide the nine spaces by moving one game piece forward and a second game piece backward, a ten indicating moving a game piece forward ten spaces or backward one space, an eleven indicating moving a game piece forward eleven spaces or switching a game piece with an opponents game piece, a twelve indicating moving a game piece forward twelve spaces, and a wild indicia indicating switching said game piece in said starting space with an opponent's game piece such that said opponent's game piece is returned to its starting space.

* * * * *